United States Patent [19]

Cleveland et al.

[11] 4,173,909

[45] Nov. 13, 1979

[54] LID LIFTER FOR RECLOSABLE SELF-SEALING BUCKETS

[76] Inventors: John H. Cleveland, 208 N. Ebbert St., Hillsboro, Oreg. 97123; Brent A. Bentley, Rte. 4, Box 274, Cornelius, Oreg. 97113

[21] Appl. No.: 855,945

[22] Filed: Nov. 30, 1977

[51] Int. Cl.[2] ..... B67B 7/00

[52] U.S. Cl. ..... 81/3.36; 81/3.46 R

[58] Field of Search ..... 81/3.36, 3.46 R, 3.46 A

[56] References Cited

U.S. PATENT DOCUMENTS

| | | | |
|---|---|---|---|
| 1,575,568 | 3/1926 | Gerhart | 81/3.36 |
| 2,339,819 | 1/1944 | Shafer | 81/3.46 A |
| 2,503,683 | 4/1950 | Perkins | 81/3.46 A X |
| 2,651,957 | 9/1953 | Phillips | 81/3.36 |

*Primary Examiner*—James G. Smith

*Attorney, Agent, or Firm*—Chernoff & Vilhauer

[57] ABSTRACT

A lid lifter arranged for releasing and removing the lid from a self-sealing reclosable container, such as a NOR-PAK bucket, is comprised of an elongate arcuate bar which is configured for tightly fitting between the paired parallel flanges which encircle such buckets near their upper ends. An elastic fastener interconnects the ends of the bar and fits around the container to secure the bar thereto. An L-shaped fulcrum plate extending outwardly and upwardly from joinder to the bar has a medial opening arranged for loosely receiving a lever which has a rectangular pad attached to its inner end. The opening is located so that the pad fits under the rim of the bucket lid in a manner to lift a portion of it simultaneously outwardly and upwardly when the lever is pivoted in the opening, thereby releasing the lid from the container and lifting it so that it wil not become reclosed when the lifter is removed. Accordingly by progressively moving the lifter around the periphery of the bucket, adjacent portions of the lid can be released until the entire lid is free to be removed.

4 Claims, 6 Drawing Figures

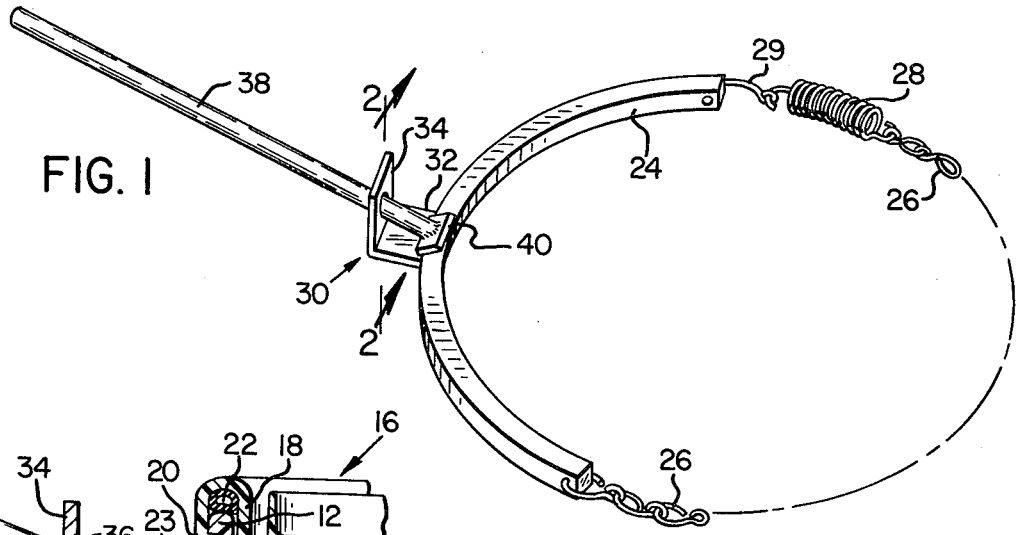
FIG. 1
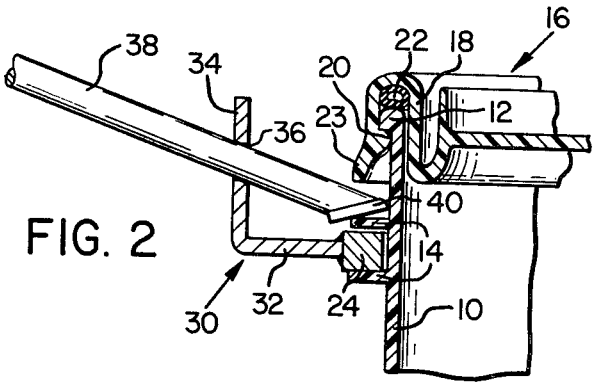
FIG. 2
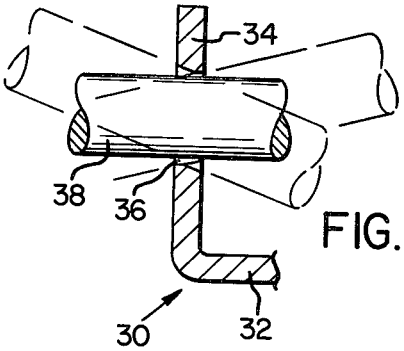
FIG. 5
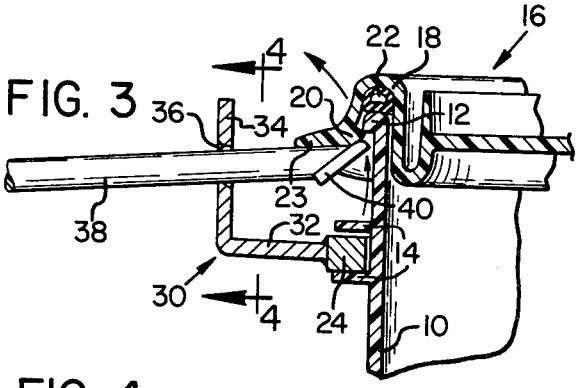
FIG. 3
FIG. 4
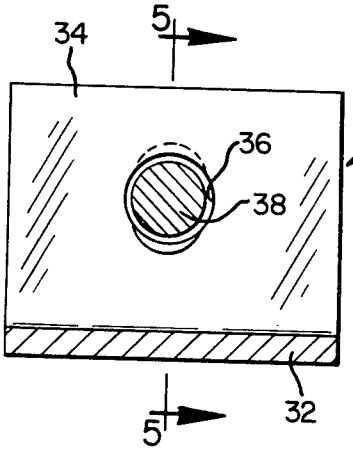
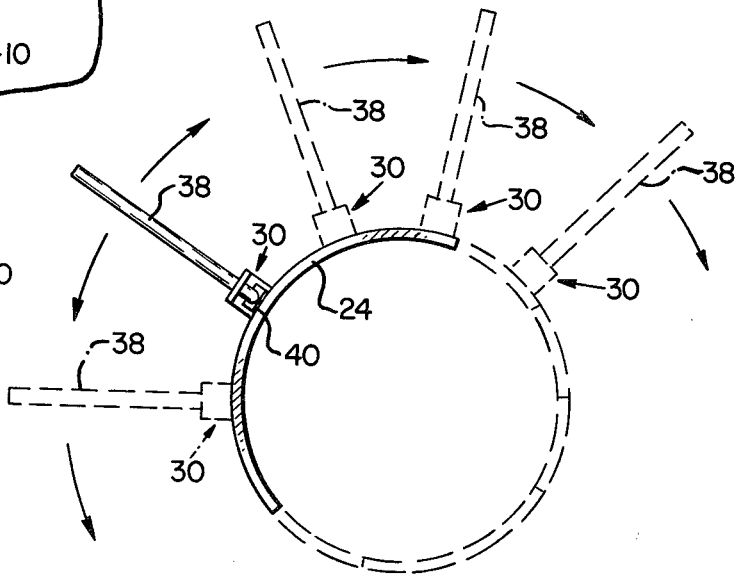
FIG. 6

LID LIFTER FOR RECLOSABLE SELF-SEALING BUCKETS

BACKGROUND OF THE INVENTION

This invention relates to a lifter for removing lids, and in particular to such a lifter which is adapted for operation on containers having self-sealing reusable lids.

Large containers or buckets having self-sealing reusable lids are commonly employed for foodstuff or similar items which cannot be exposed to air. Containers of this type are sold under the trademark NORPAK.

While containers of this type are widely accepted due to their reclosing feature, they are quite difficult to open due to the stiffness of the lid and the pressure exerted on the catch elements both of which are necessary for self-sealing. While the lids can be pried loose without damaging them, it is difficult to do so and it can only be accomplished with great exertion and under the threat of injury if the prying tool should slip.

While lid lifters utilizing the fulcrum principle of the present invention have been provided in the past, they are adapted for other applications and are not capable of being used for removing lids from containers of the class described. Lid lifters of the prior art are shown for example in Green, U.S. Pat. No. 1,250,448, Standish, U.S. Pat. No. 1,359,629 and Baily U.S. Pat. No. 1,511,315. All of the prior art lifters are intended for removing lids from canning jars of similar containers and do not provide the necessary attachment hardware to transfer the force necessary for removing lids from containers of the subject class; nor do they provide the particular lifting action necessary to lift the rim of the lid simultaneously outwardly and upwardly to unseat the catch elements.

SUMMARY OF THE INVENTION

The lid lifter of the present invention is comprised of an elongate arcuately shaped bar having a rectangular cross section which is configured for snugly fitting between the paired flanges that are located near the top of buckets of the type having reclosable, self-sealing lids. Joined to the bar, proximate its center, is an outwardly and upwardly extending L-shaped fulcrum plate which has a medial opening passing through it. Loosely fitting within the opening is an elongate lever having a rectangular pad attached to its inner end. The pad is oriented so that its transverse axis forms an acute angle with the longitudinal axis of the lever and its longitudinal axis is normal to the longitudinal axis of the lever. Thus by pivoting the lever in the opening, the lever can be wedged under the rim of the lid to disengage a portion of the inwardly facing catch, which is located on the lid, from the mating portion of the outwardly facing lip, which is located at the top of the container. In addition to forcing the lid outwardly, the lifter simultaneously raises it upwardly to offset the catch from the lip so that they will not re-engage when the lifter is removed. By moving the lifter progressively around the container, the lid can eventually be freed entirely for its removal.

Accordingly it is the principal objective of the present invention to provide a lifter for removing the lids of containers having reusable self-sealing lids.

It is a further object of the present invention to provide such a lifter which is easy to operate.

It is a further object of the principal invention to provide such a lifter which is of straightforward design for inexpensive manufacture.

The foregoing objectives, features and advantages of the present invention will be more readily understood upon consideration of the following detailed description of the invention taken in conjunction with the accompanying drawings.

BRIEF DESCRIPTION OF THE DRAWINGS

FIG. 1 is a pictorial view showing a preferred embodiment of the lid lifter of the present invention.

FIG. 2 is a sectional view taken on the line 2—2 of FIG. 1.

FIG. 3 is a sectional view, similar to that of FIG. 2, showing the operation of the lifter.

FIG. 4 is a sectional view taken on the line 4—4 of FIG. 3.

FIG. 5 is a sectional view taken on the line 5—5 of FIG. 4.

FIG. 6 is a semidiagrammatic view showing the operation of the lifter.

DETAILED DESCRIPTION OF THE INVENTION

The lid lifter of the present invention is used to remove the lid from containers having releasable self-sealing closure means. Containers of this type are commonly used for packaging food or other spoilable products and are typified by NORPAK containers. Referring to FIG. 2, a container of this class generally comprises an open-topped cylindrical shell 10 having a radially outwardly facing flat bottom lip 12 at its upper end. Located on the outer wall of shell 10, a short distance below lip 12, are paired spaced-apart flanges 14. The walls of the shell are thick enough not to be easily bent even though the container is formed from a plastic material.

The top of the container is removably covered by a lid 16 which has a U-shaped peripheral cap 18 arranged for fitting over the top of the container. The cap is fabricated from the same material as the container and also is thick so that it is not easily bent and its outer wall includes a catch 20 which is configured to engage lip 12. The cap is arranged to tightly fit over lip 12, thereby requiring catch 20 to be urged outwardly by the lip when the lid is installed and thereafter to be snapped into locking engagement with it. The catch is urged upwardly against the lip by an O-ring 22 which is compressed slightly when the lid is installed to seal the container. The outer edge of cap 18 extends past catch 20 and is flared outwardly to form a rim 23.

Referring now to FIG. 1, the lid lifter includes an arcuate bar 24 having a rectangular cross section arranged for a snug fit between flanges 14. In order to spread the load carried by it over a large extent of the flanges, bar 24 is shown as covering a wide arc, which preferably ranges from 130° to 180°. The bar is secured to the container by elastic fastening means, such as chain 26 and spring 28, which is fixedly attached to one end of the bar and releasably attached to the other end of the bar by means of hook 29.

Attached to the bar, such as by welding, is an L-shaped fulcrum plate 30 having a horizontal leg 32 which is joined at the middle of bar 24 and which extends outwardly from it. A vertical leg 34, which extends upwardly from the horizontal leg substantial normal to it, has a central opening 36 passing therethrough.

Opening 36 is located so that it lies immediately below lip 12 when bar 24 is inserted between flanges 14 and it is beveled upwardly at its outer edge and downwardly at its inner edge as is best illustrated in FIGS. 4 and 5.

Loosely fitting through opening 36 is an elongate lever 38, which is illustrated as being cylindrical. The lever is dimensioned so that it is freely pivotable in opening 36, at least over the range shown in FIG. 5. A rectangular lifting pad 40 is attached to the inner end of lever 38 with the longitudinal axis of the pad being normal with respect to the longitudinal axis of lever 38 and the transverse axis of the pad being oriented at an acute angle with respect to the longitudinal axis of the lever. The above acute angle preferably lies between 25° and 70° and is shown in the embodiment illustrated as being 35°.

In use, the device is located on the container by inserting bar 24 between flanges 14 and it is attached to the container by extending chain 26 around the container and placing hook 29 into the end of the bar. The chain must be sized for the particular container so that spring 28 is slightly extended thereby holding the bar tightly between flanges 14 while still allowing it to be rotated around the container.

After the lifter is attached to the container, the outer end of lever 38 is rotated upwardly and inwardly to place pad 40 below rim 23 as shown in FIG. 2. The lever is then urged downwardly, FIG. 3, so that pad 40 is swung under the rim to pull the rim upwardly and outwardly. Accordingly, that portion of catch 20 located adjacent to pad 40 is pulled outwardly to disengage it from lip 12, and simultaneously it is raised above the lip so that it will not become re-engaged with the lip when the lifter is removed. The lifter then is rotated on the container, FIG. 6, and the above procedure is repeated to release another portion of the lid, until the entire lid is free thereby allowing its removal.

It will be noted that the particular structure of the present invention allows moving catch 20 simultaneously outwardly and upwardly to both disengage it from lip 12 and to raise it above the lip so that it will not lock again unless the lip is pushed downwardly.

The terms and expressions which have been employed in the foregoing abstract and specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A lifter for non-destructively removing the lid from a container of the type having a radially outwardly facing lip at its upper extremity configured for releasably engaging a radially inwardly facing mating catch on the lid when the lid is urged downwardly over the container, and having paired, spaced-apart outwardly extending flanges located near its upper extremity below the lower most extension of the lid when the lid is installed on the container, said lifter comprising:

(a) an arcuate bar having a width which allows it to be received snugly between said outwardly extending flanges of said container;

(b) fastening means for releasably interconnecting the respective ends of said bar for securing said bar to said container;

(c) a fulcrum plate attached to said bar approximately intermediate its ends and extending radially outwardly and upwardly therefrom;

(d) said fulcrum plate defining a central opening which is slightly below said lip when said lifter is installed on said container;

(e) a cylindrically cross-sectioned, elongate lever having a diameter which loosely fits within said opening, said lever having a longitudinal axis which fits through said opening so that said opening defines a pivot axis about which said lever can be pivoted; and (f) a lifting pad located at the end of said lever, one axis of said lifting pad being acutely angled with respect to the longitudinal axis of said lever so that when said lever is pivoted in said opening, said lifting pad engages said catch and lifts it both outwardly and upwardly to release said catch from engagement with said outwardly facing lip, thereby releasing said lid from said container.

2. The lifter of claim 1 wherein said fulcrum plate is L-shaped in cross section and has a horizontal leg which extends radially outwardly, and a vertical leg which extends upwardly from said horizontal leg generally normally thereto.

3. The lifter of claim 1 wherein said bar extends over an arc having an included angle within the range of 130° to 180°.

4. The lifter of claim 1 wherein said lifting pad is rectangular and has a longitudinal axis which is perpendicular to the longitudinal axis of said lever and a transverse axis which is angled with respect to the longitudinal axis of said lever at an angle ranging between 25° and 70°.

* * * * *